US005396747A

United States Patent [19]

Breuning

[11] Patent Number: 5,396,747

[45] Date of Patent: Mar. 14, 1995

[54] PLANE HOLLOW REINFORCED CONCRETE FLOORS WITH TWO-DIMENSIONAL STRUCTURE

[76] Inventor: Jørgen I. Breuning, 8, Rosevangen, Farum, Denmark, DK-3520

[21] Appl. No.: 39,018

[22] PCT Filed: Sep. 30, 1991

[86] PCT No.: PCT/DK91/00297

§ 371 Date: Mar. 31, 1993

§ 102(e) Date: Mar. 31, 1993

[87] PCT Pub. No.: WO92/06253

PCT Pub. Date: Apr. 16, 1992

[30] Foreign Application Priority Data

Oct. 1, 1990 [DK] Denmark ..... 2375/90

[51] Int. Cl.[6] ..... E04C 3/30

[52] U.S. Cl. ..... 52/516; 52/577

[58] Field of Search ..... 52/596, 319, 600, 607, 52/380, 405.1, 808, 576, 577; 428/14, 117, 256, 255

[56] References Cited

U.S. PATENT DOCUMENTS

| | | | |
|---|---|---|---|
| 550,612 | 12/1895 | Hammerstein | 52/577 X |
| 584,875 | 6/1897 | Jameton | 52/577 |
| 3,229,437 | 1/1966 | Adie | 52/576 |
| 3,328,932 | 7/1967 | Cheskin | 52/577 X |
| 3,488,909 | 1/1970 | Bahr | 52/577 |
| 4,702,048 | 10/1987 | Millman | 52/577 X |

FOREIGN PATENT DOCUMENTS

| | | | |
|---|---|---|---|
| 11 06 916 | 5/1961 | Germany | 52/380 |

*Primary Examiner*—Carl D. Friedman
*Assistant Examiner*—Creighton Smith
*Attorney, Agent, or Firm*—Fitch, Even, Tabin & Flannery

[57] ABSTRACT

A plane, hollow, reinforced concrete floor slabs with two-dimensional structure and method for their production. Constructions developed by this technic will vary widely and with considerable profit replace conventional floor structures. The technique makes it possible to choose higher strength and stiffness, less volume of materials, greater flexibility, better economy or an arbitrary combination of these gains. The technique makes it possible to create a total balance between bending forces, shear forces and stiffness (deformations)—so that all design conditions can be fully optimized at the same time. The technique presents a distinct minimized construction—characterized by the ability that concrete can be placed exactly where it yields maximum capacity. The technique offers material and cost savings compared with the conventional compact two-way reinforced slab structure. The technique is suitable for both in situ works and for prefabrication.

6 Claims, 6 Drawing Sheets

PLANE HOLLOW REINFORCED CONCRETE FLOORS WITH TWO-DIMENSIONAL STRUCTURE

BACKGROUND OF THE INVENTION

1. Field of the Invention

The invention relates to plane, hollow, reinforced concrete floors with two-dimensional structure and span in arbitrary direction. The present floor structure is part of a complete construction system developed for obtaining increased flexibility and a large beamless span.

2. Background Art

The weakness of concrete floor structures is considered well-known. Concrete floor structures have one fault. The dead load is usually 2–4 times heavier than the useful load capacity. This situation has resulted in numerous attempts being made to make the construction less heavy, mostly by forming various types of kind of internal cavities. Yet, no one has ever succeeded in finding a general solution to the problem. In order to obtain a practical solution, a large number of conflicting conditions necessarily have to be fulfilled. All previous attempts have been directed to the simple "one-dimensional" structure (span in one direction) rather than to the much more complex "two-dimensional" structure (span in arbitrary direction). The two constructions have quite different static functions and cannot be compared.

Since the 1950's, floors with one-dimensional structure have been fully developed by means of the prefabricated and prestressed hollow concrete element, where the hollow profile is made by monolithic concreting around steel pipes, which are drawn out of the element after cementation leaving cylindrical cavities in the concrete. The floor achieves maximum bearing strength corresponding to the concrete volume. However, the floor construction can only be made as a prefabricated element, and the load capacity exists only in one direction. This shortcoming impedes the whole building structure, as the construction has to be adapted to the floor elements to a large extent. The building system suffers from the necessity of bearing walls or beams and offers no true flexibility.

DE 2.116.479 (Hans Nyffeler April 1970) discloses the use of balls of lightweight materials instead of the mentioned pipes, whereby shortening of prefabricated pipes on the site may be avoided. In order to form a row of balls, the ball are provided with a through-going, central bore and threaded on a bar. The bars with the balls are supported by the reinforcement by means of chairs.

This idea has several drawbacks, which make it quite unrealistic. For instance the hollow balls within the bore will be surrounded by concrete, whereby the method is extraordinarily difficult to carry out in practice. Consequently, it can be concluded that the idea is possible in theory, but is in no way realistic. In connection with two-dimensional structures, the idea cannot be implemented at all. It would be completely impossible to thread balls on crossed bars.

Floors with a two-dimensional structure cannot be used rationally in conventional solid designs, especially in combination with supporting columns, because of the high weight/thickness ratio.

Without the use of columns, the application of a solid floor is restricted to small elements with a side length of about 3 to 5 meters, whereby the whole building structure is restricted to a very small structural module, thus this system also has a very limited flexibility.

No technique known from one-dimensional, hollow structures can be transferred to a two-dimensional, hollow structure.

SUMMARY OF THE INVENTION

The present invention solves the general problems of improving the shear conditions and providing internal cavities in a very simple manner. Hollow bodies (air pockets) and reinforcement are integrated in a locked geometric and static unit by arranging the hollow bodies in the reinforcement mesh, whereby the mutual position of the hollow bodies is essentially fixed in the horizontal direction.

In vertical direction, the hollow bodies may be fixed by means of an upper mesh, which is connected to the reinforcement mesh by means of connection bars, whereby an internal lattice of steel and hollow bodies are formed for embedding in a monolithic concreting according to usual practice.

The internal cavities formed by hollow bodies meet all seven technical conditions stated below

| | |
|---|---|
| 1. simple shape and arrangement | (feasibility) |
| 2. closed body | (water-tightness) |
| 3. strength | (inflexibility at contact points) |
| 4. reliable fixing | (during transportation and concreting) |
| 5. symmetrical body | (2-axes of symmetry or rotation) |
| 6. symmetrical structure | (2-axes of symmetry or rotation) |
| 7. no obstacles for (continuous) monolithic concreting. | |

From these criteria, hollow bodies have been developed with shapes essentially ellipsoidal and spherical. For practical reasons, the hollow bodies may be formed as separate members for assembly with possibilities for variation.

By the present invention, 30–40% of the concrete may be replaced by air. The result is a two-dimensional plane, hollow floor structure weighing less, having higher strength and higher rigidity than all known floor structures and in fact having essentially an unlimited load capacity and versatility resulting in a better economy. The present invention has the following advantages in relation to traditional solid floors:

A 40% to 50% saving in concrete materials is gained and 30% to 40% saving in steel materials is gained; or increased strength of 100% to 150% is gained or increased span of up to 200% is gained.

BRIEF DESCRIPTION OF THE DRAWINGS

The invention and a preferred method for carrying out the invention is explained in detail in the following with reference to the drawings showing examples of the preferred embodiments with the hollow bodies arranged in the reinforcement mesh, and in which the modifications illustrated in FIGS. 6–13 have the same floor thickness, and in which.

DESCRIPTION OF PREFERRED EMBODIMENTS

Figure 1:
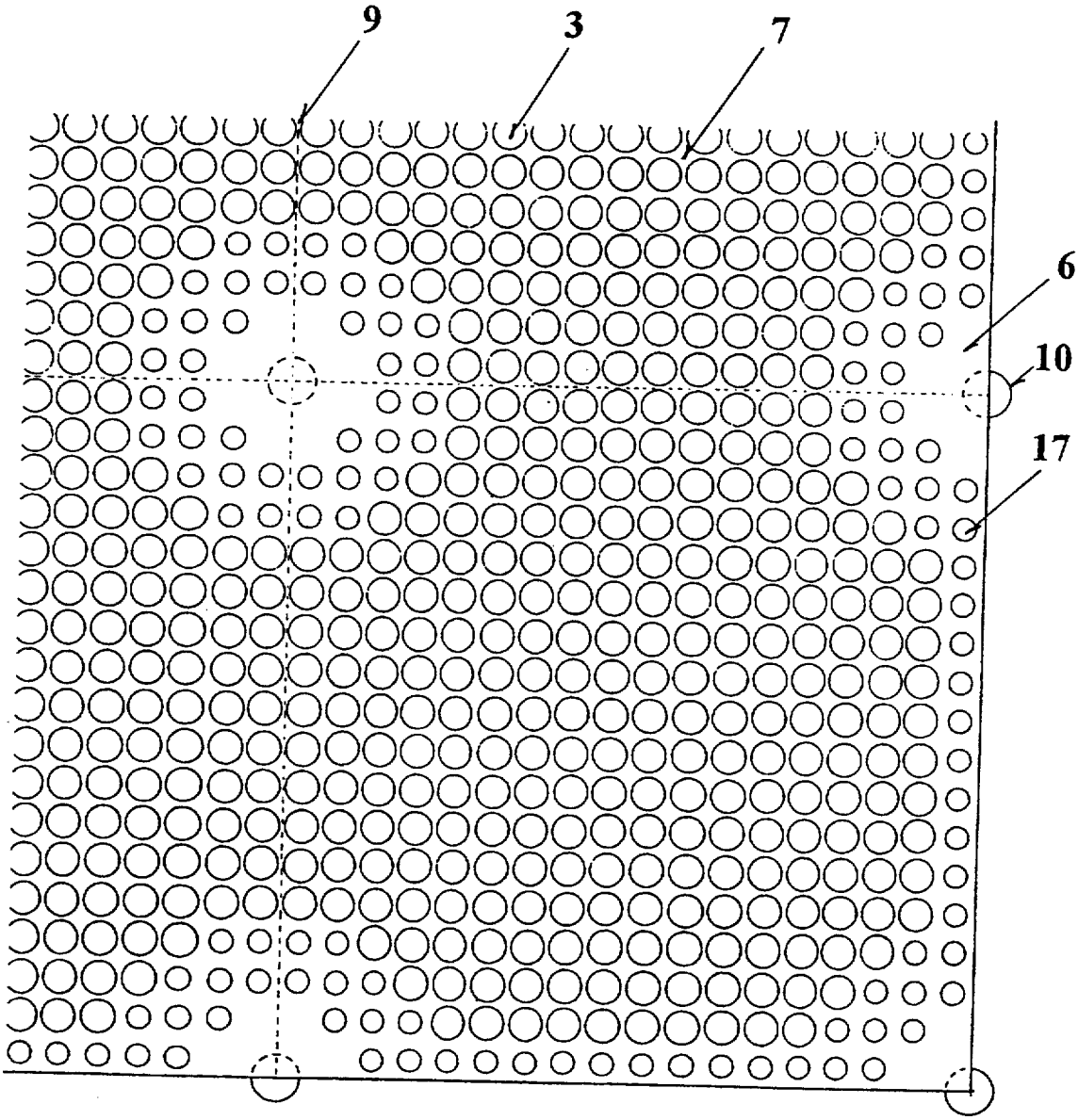
FIG. 1 is a plane view of floor structure with hollow bodies and supported on columns.
Figure 2:
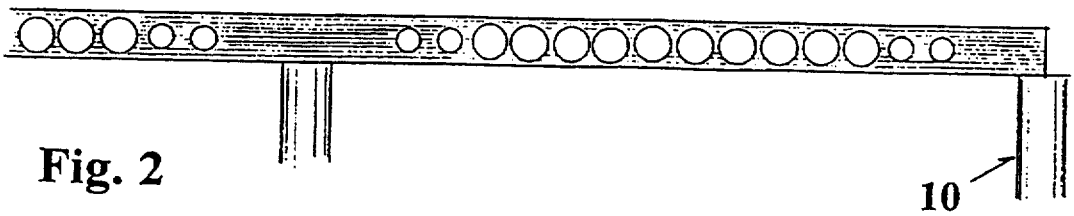
FIG. 2 is sectional view of the same floor structure.
Figures 3, 4, 5:
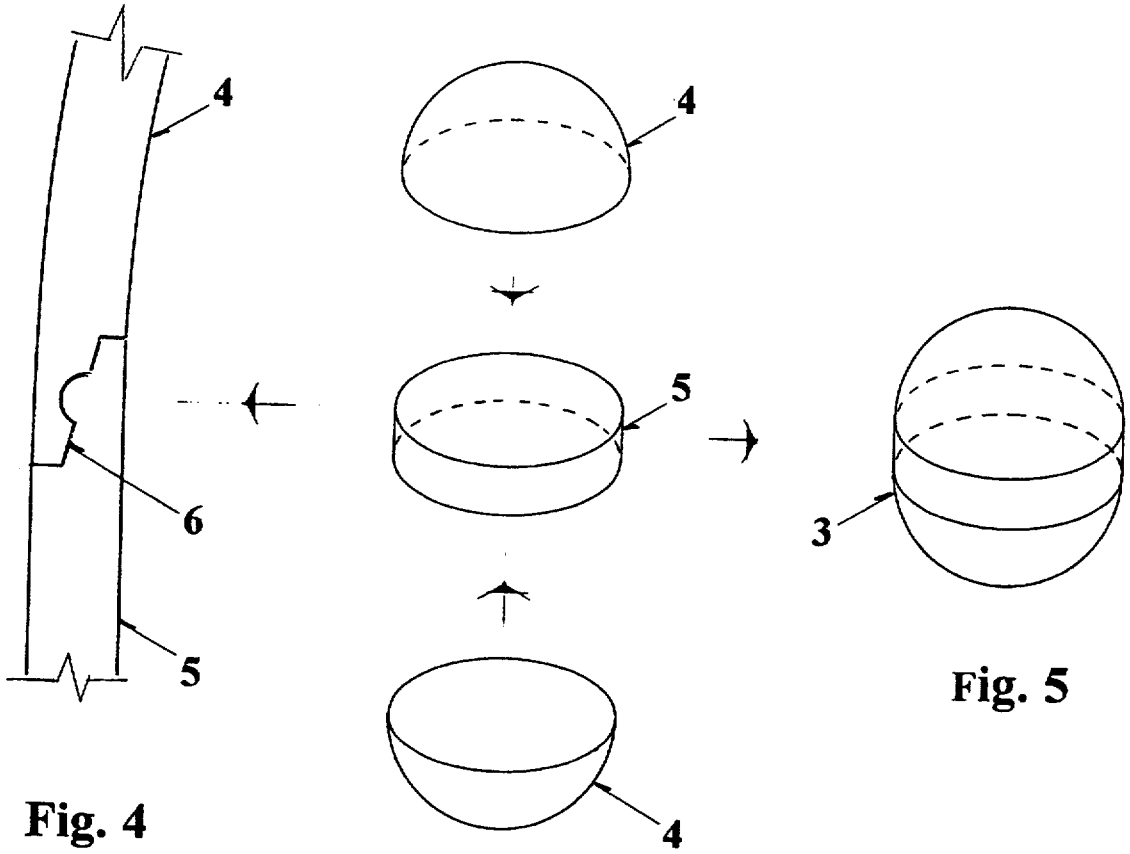
FIG. 3 shows the different elements forming a hollow body.
FIG. 4 shows the locking means between the elements.
FIG. 5 shows an assembled body.
Figure 6:
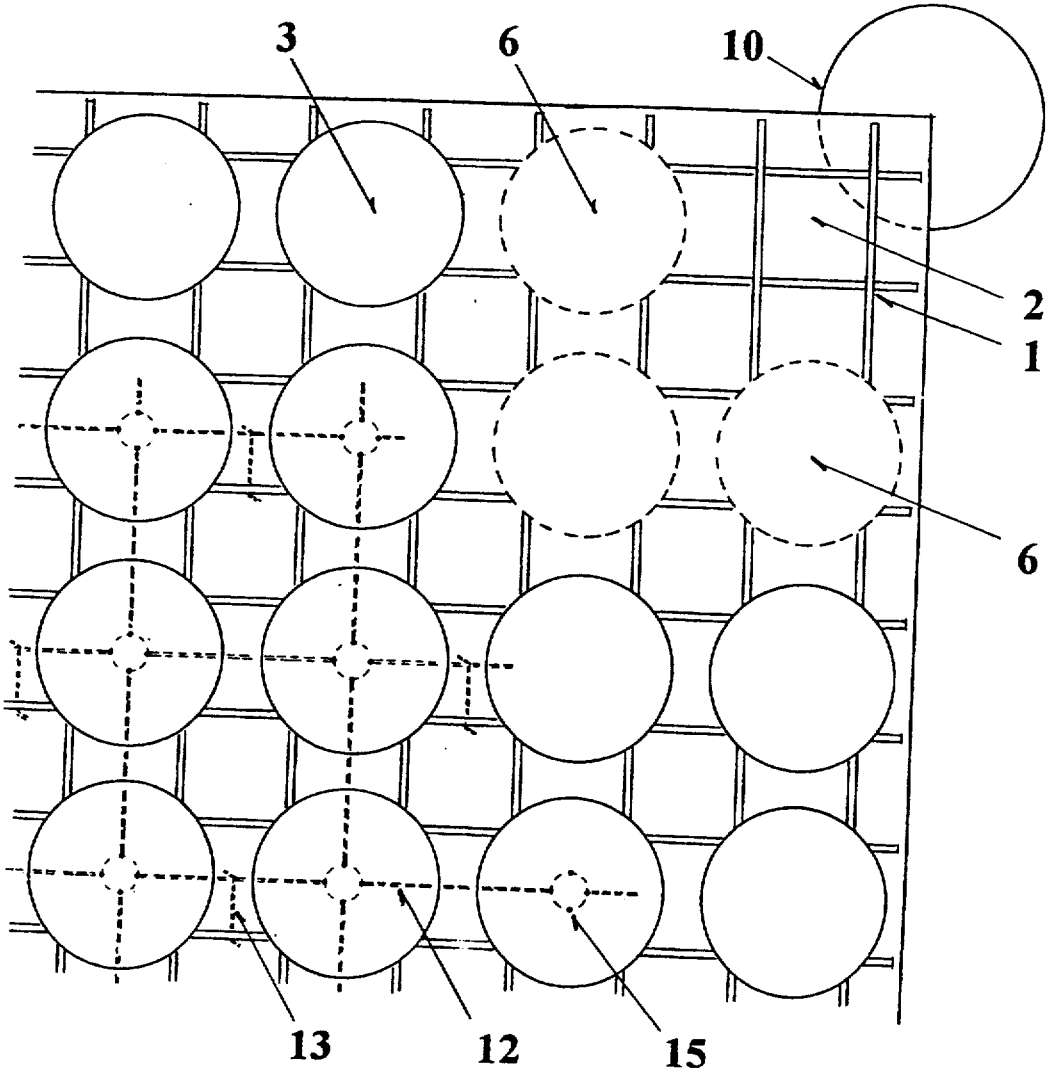
FIG. 6 is a plane view of a floor element with ball-shaped hollow bodies arranged in every second mesh and fixed at the top by means of connecting bars.
Figure 7:
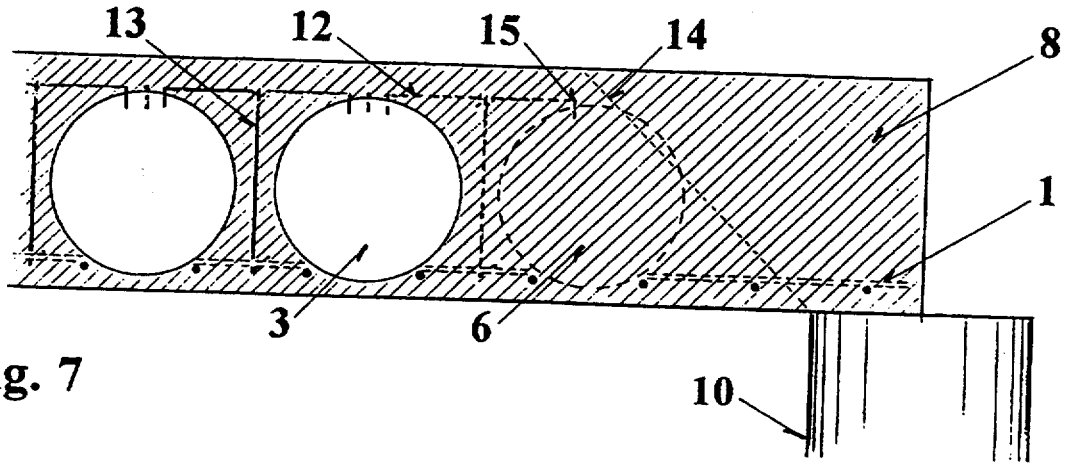
FIG. 7 is a sectional view of the same element shown in FIG. 6.
Figure 8:
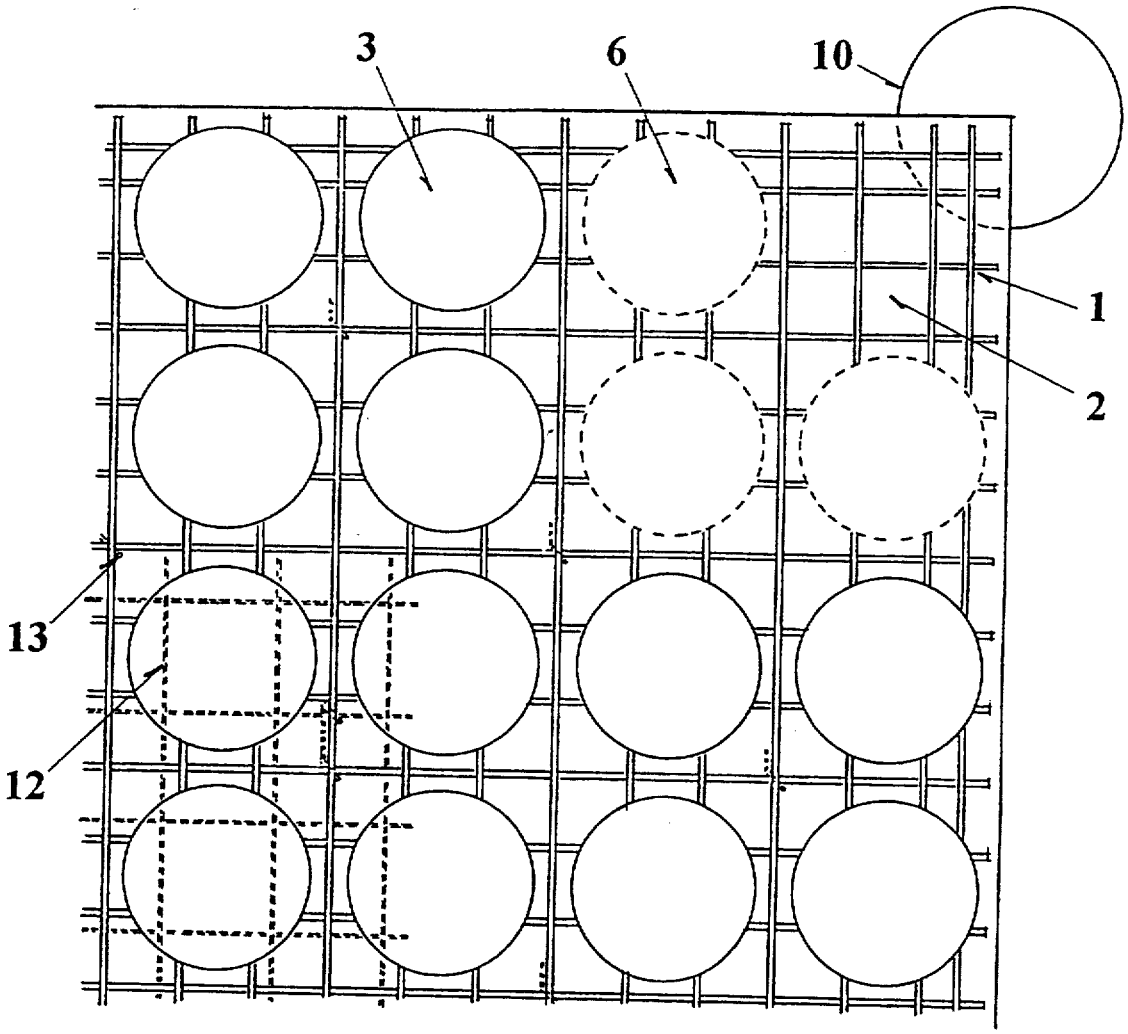
FIG. 8 is a plane view of a floor element with ball-shaped hollow bodies arranged in every third mesh and fixed at the top by means of mesh.
Figure 9:
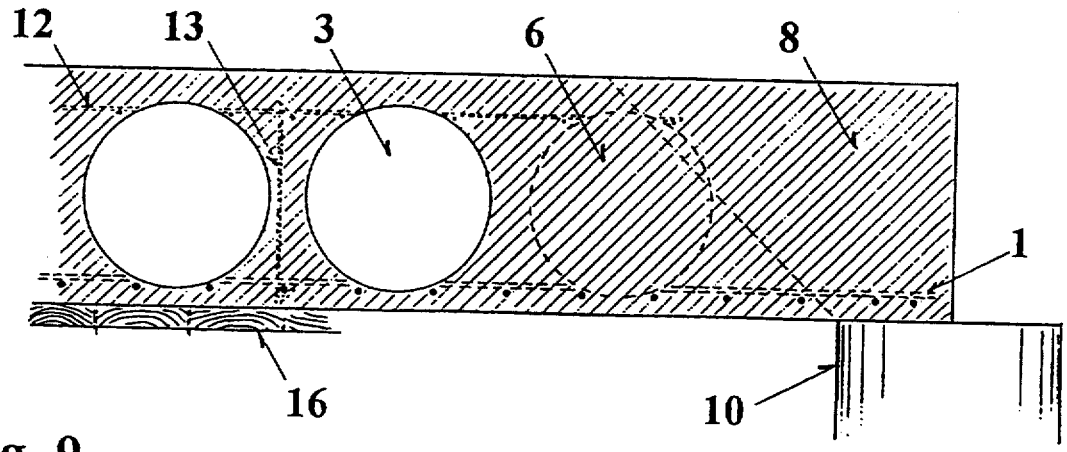
FIG. 9 is a sectional view of the same element shown in FIG. 8.
Figure 10:
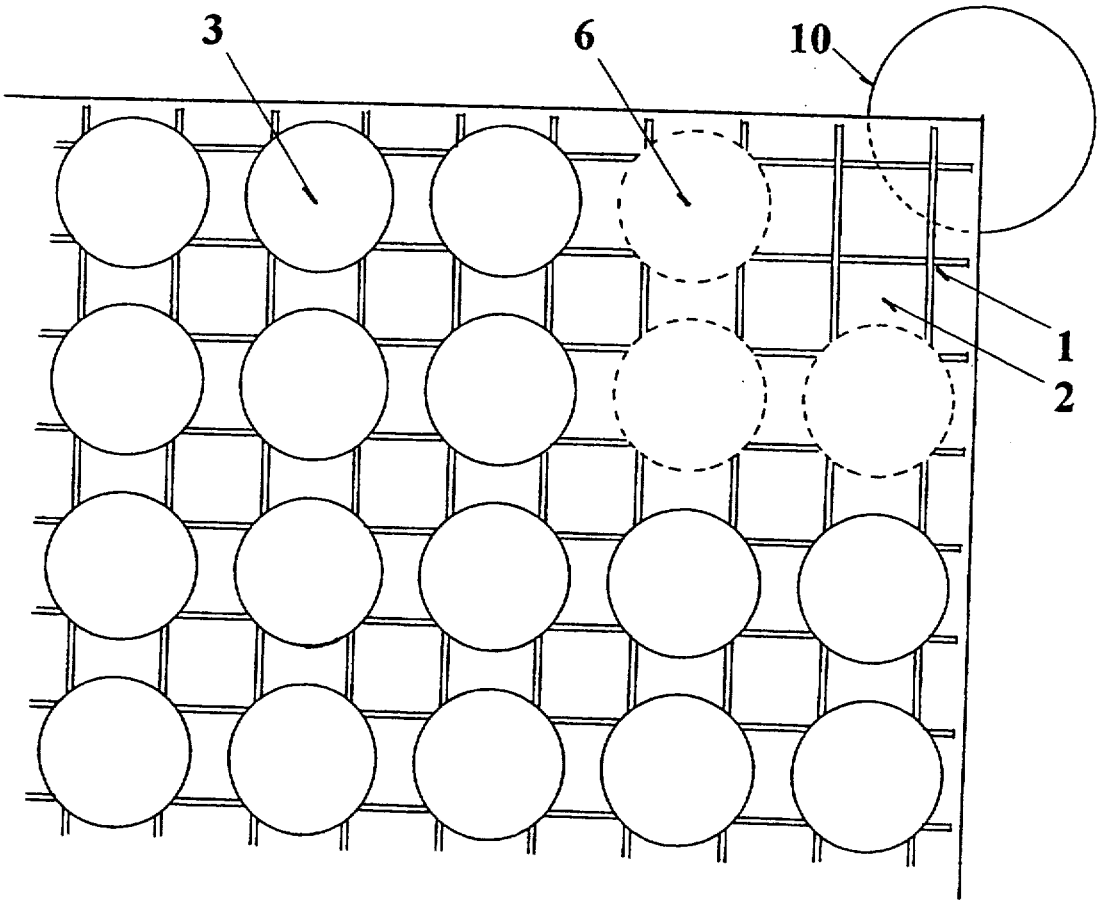
FIG. 10 shows a plane view of floor section with ellipsoid-shaped hollow bodies arranged in every second mesh.
Figure 11:
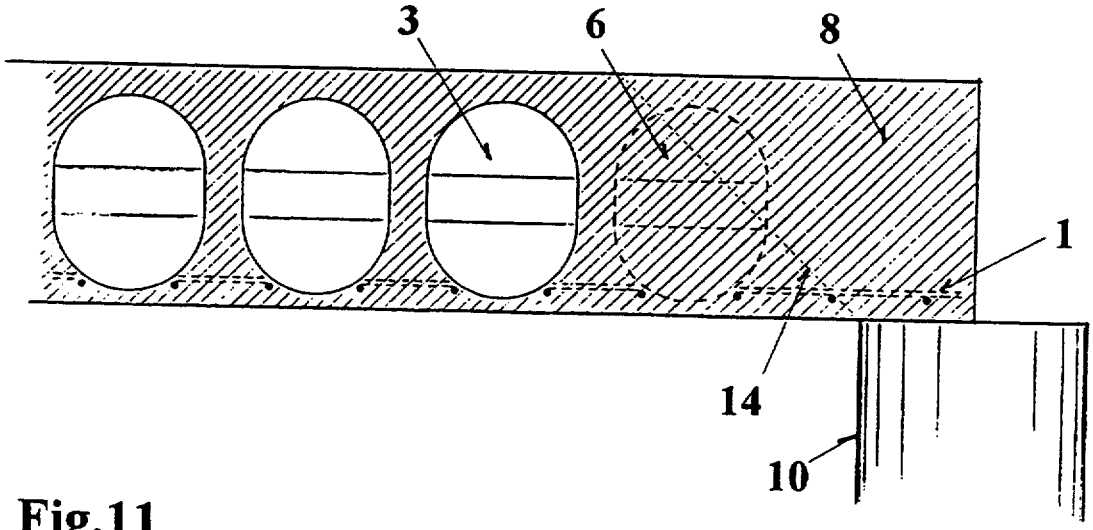
FIG. 11 is a sectional view of the same element shown in FIG. 10.
Figure 12:
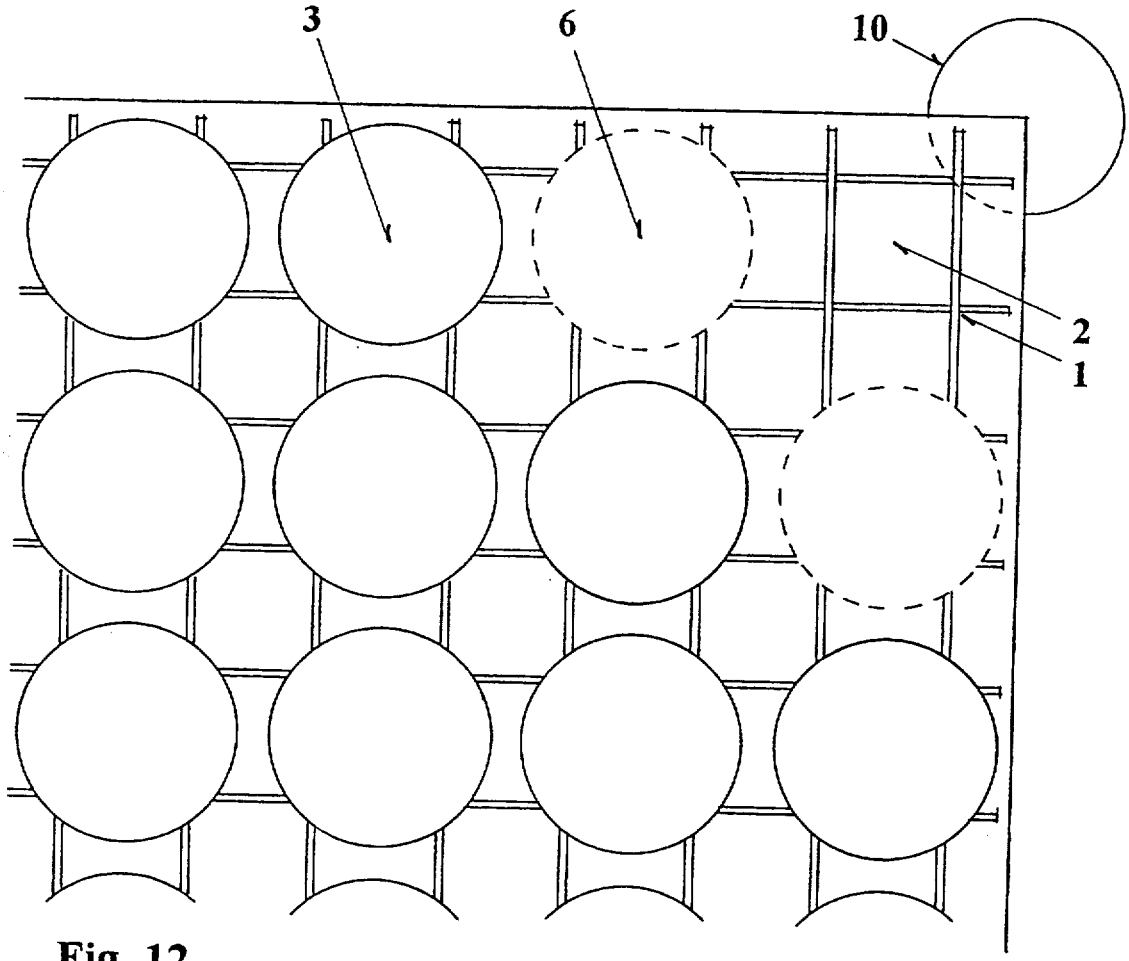
FIG. 12 is a plane view of floor element with ellipsoid-shaped hollow bubbles arranged in every second mesh.
Figure 13:
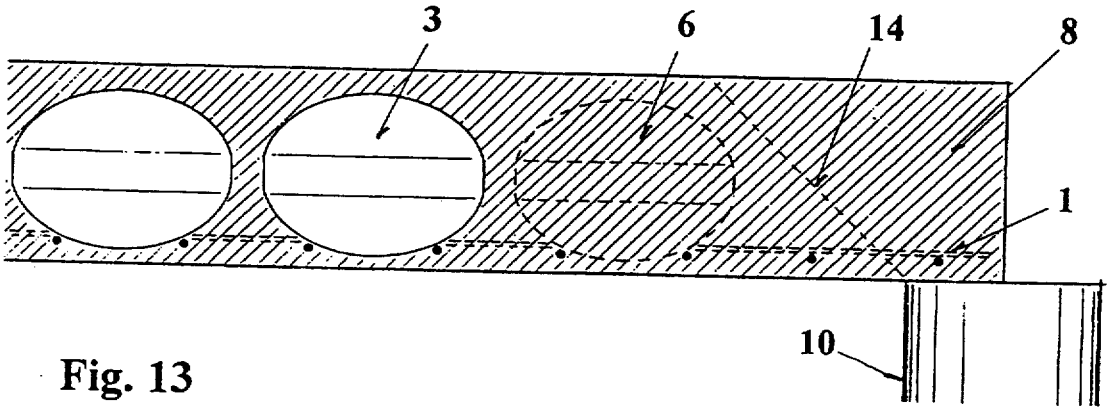
FIG. 13 is a sectional view of the same element shown in FIG. 12.

There exists no substantial difference between carrying out prefabrication and in situ work, so the latter will be described below. A two-way reinforcement mesh 1 is arranged in the form 16 in ordinary manner (see FIGS. 6–13), and fixed to the bottom thereof. Then the hollow bodies 3 are placed directly on the reinforcement I in every second mesh 2. The bodies 3 are retained in position by an upper net 12 as shown in FIG. 8. Alternatively, the bodies may be retained by a connecting bar or wire inserted into predetermined openings 15 in the bodies 3 as shown in FIG. 6. The two steel nets 1,12 and the bodies 3 therebetween form a stable lattice, the two nets 1,12 being interconnected by means of conventional connecting bars or wires 13.

The completed three-dimensional stable lattice of steel 1,12 and hollow bodies 3 are thus ready for concreting in the conventional manner.

If desired, the vertical connection between the two nets may be made suitably loose to allow buoyancy to lift the bodies and thereby ensuring complete concreting of both mesh and bodies.

The finished floor structure appears as a cross web construction with a plane upper and lower surface (a three-dimensional concrete lattice). It should be noted that the production thereof is no more time-consuming than a conventional floor construction with double reinforcement.

The calculations below illustrate the advantages of the hollow body floor (o) according to the invention compared to a traditional solid floor (m) .

A. Same Thickness of the Two Floors

| A 32 CM SOLID FLOOR VS. A 32 CM HOLLOW BODY FLOOR | | |
|---|---|---|
| Loads (m) | solid floor | hollow body floor (o) |
| dead load $g_1$ = | $7.7 \times 10^3$ N/m$^2$ | $5.1 \times 10^3$ N/m$^2$ |
| floor finish $g_2$ = | 0.4 | 0.4 |
| light partitions $g_3$ = | 0.5 | 0.5 |
| load capacity p = | 1.5 | 1.5 |

-continued

| A 32 CM SOLID FLOOR VS. A 32 CM HOLLOW BODY FLOOR | | |
|---|---|---|
| Loads (m) | solid floor | hollow body floor (o) |
| design load $q = \sum_1^3 g_i + 1.3\ p =$ | $10.6 \times 10^3$ N/m$^2$ | $8.0 \times 10^3$N/m$^2$ |

The calculations are based on the same static conditions in the two floors:

same effective thickness of the concrete $h_e$
same pressure zone = 20% of $h_e$
same moment arm = 90% of $h_e$ $h_e$ being the total thickness of the floor and the concrete cover having a thickness of 3 cm.

1. Gain in Load Capacity

| With the same support the load on the hollow body floor may be increased | |
|---|---|
| by | $(10.6 - 8.0)/1.3 = 2.0 \times 10^3$ N/m$^2$ |
| to | $1.5 + 2.0 = 3.5 \times 10^3$ N/m$^2$ |
| or | $100 \times 2.0/1.5 = 130\%$ |

2. Gain in Free Span

If calculations are based on the bending force:

M (moment of force) = load (q) × width (k) × length (l) = load (q) × area (A)
$M_m$ (solid)$\sim q_m \times A_m = 10.6\ A_m$
$M_o$ (hollow body)$\sim q_o \times A_o = 10.6\ A_o$
$M_m/M_o = 10.6/8.0) \times A_m/A_o = 1.33\ A_m/A_o$
For $M_m = M_o$
$A_o = 1{,}33\ A_m$ Calculations based on shear force give a similar result. In both cases an increase of 33% is achieved, i.e. 16% in each direction.

B. Same Load Capacity

1. If a Solid Floor Should Have the Same Load Capacity as a Hollow Body Floor

With a load capacity $\rho_o = 3.5 \times 10^3$ N/m$^2$
the thickness is as an
estimate increased from 32 cm to 46 cm
corresponding to an increase of
the dead load of 45%
or an extra dead load of $3.5 \times 10^3$ N/m$^2$ Control of Estimate The estimated thickness of 46 cm result in

| | |
|---|---|
| a dead load of | $7.7 \times 46/32 = 11.0 \times 10^3$ N/m$^2$ |
| permanent load (load of floor finish ($g_2$) and partition ($g_3$) | $0.9 \times 10^3$ N/m$^2$ |
| load capacity | $3.5 \times 10^3$ N/m$^2$ |
| design load: $q_m$ | $16.4 \times 10^3$ N/m$^2$ |
| $M_m/M_o = q_m/q_o = 16.4/8.0 = 2.1$ | |
| As $M_{m/M}O = (h_m/h_o)^2 = 2.1$ | |

where $h_m$ and $h_o$ are the arm of moment for the solid floor and the hollow body floor, respectively $h_m/h_o = 1.45$
and $h_m = 32 \times 1.45 = 46$ cm,
i.e. the estimate is correct.

2. Reduction in Thickness of a Hollow Body Floor (o) Having the Same Load Capacity as a Solid Floor (m)

| | |
|---|---|
| load capacity $\rho_m = 1.5 \times 10^3$ N/m$^2$ | |
| As an estimate the thickness could be reduced by 6 cm from 32 cm to 26 cm corresponding to a reduction in the dead load of approx. | 20% |
| or a total load reduction 7.7–7.7 $(1.2)^2 = 3.5 \times 10^3$ N/m$^2$ | |
| corresponding to | 45% |
| Control of estimate | $5.1 \times 26/32 = 4.2 \times 10^3$ N/m$^2$ |
| The estimated thickness of 26 cm results in a dead load of | |
| Permanent load (load of force and floor finish ($g_2$) and partitions ($g_3$)) | $0.9 \times 10^3$ N/m$^2$ |
| Load capacity | $1.5 \times 10^3$ N/m$^2$ |
| Design load $q_o$ | $7.1 \times 10^3$ N/m$^2$ |
| $M_o/M_m \sim q_o/q_m = 7.1/10.6 = 0.67$ | |
| As $M_o/M_m \sim (h_o/h_m)^2 = 0.67$ | |
| Where $h_m$ and $h_o$ are the arm of moment for the solid floor and the hollow body floor, respectively | |
| $h_o/h_m = 0.82$ | |
| and | |
| $h_o = 32 \times 0.82 = 0.26$ | |
| The estimate is thus correct. | |

C. Same Weight

| A 32 CM HOLLOW BODY FLOOR vs. A 21 CM SOLID FLOOR |
|---|
| Same load |
| dead load $g_1 = 5.1 \times 10^3$ N/m$^2$ |
| floor finish $g_2 = 0.4$ |
| light partitions $g_3 = 0.5$ |
| load capacity $\rho = 1.5$ |
| design load $q = \sum_1^3 g_i + 1.3\,p = 8.0 \times 10^3$ N/m$^2$ |

1. Gain in Bending Strength $M_m = M_o \sim qkl = qA$
As $M_o/M_m = (h_o/h_m)^2$
$M_o/M_m = (32\text{-}3/21\text{-}3)^2 = 2.6$ Thus, the bending strength for hollow body floor is 160% larger than for a solid floor.

2. Gain in Shear Strength

The shear strength will also be increased by more than 100%, but depends on the width of the support besides the thickness.

3. Gain in Free Span $M_o/M_m = qA_o/qA_m = 2.6$

-continued $A_o/A_m = 2.6$

The free floor area (span) of a hollow body floor is 160% larger than the free area of a solid floor, or 60% in each direction.

What is claimed is:

1. A hollow, two-way reinforced concrete floor, comprising:

an upper reinforcement mesh having openings;

a lower reinforcement mesh having openings and disposed substantially parallel to the upper reinforcement mesh;

a plurality of hollow bodies disposed between the upper mesh and the lower mesh, the bodies being dimensioned and shaped so as to extend into respective openings of both the upper and lower meshes and be retained by the meshes;

interconnecting means for interconnecting the upper mesh and the lower mesh to form an independent stable lattice work retaining the hollow bodies; and the independent stable lattice work retaining the hollow bodies imbedded in concrete, with the hollow bodies defining internal cavities.

2. A hollow, reinforced concrete floor structure according to claim 1, wherein the hollow bodies comprise closed, thin shells.

3. A hollow, reinforced concrete floor structure according to claim 1, whereby the upper mesh is essentially identical to the lower mesh.

4. A hollow, two-way reinforced concrete floor in accordance with claim 1 in which the hollow bodies comprise two bowl-shaped end parts and an essentially cylindrical intermediate part being sealingly interconnected.

5. A plane, hollow, reinforced concrete floor with a substantially two-dimensional structure comprising hollow bodies and a reinforcement mesh formed by crossing rods and having openings into which the hollow bodies extend to be at least partially retained by means of the rods, said hollow bodies being retained vertically by means of retaining means connected to the reinforcement mesh, said reinforcement mesh and said retaining means forming an independent stable lattice retaining the hollow bodies and being embedded in concrete with the hollow bodies defining internal cavities wherein the hollow bodies comprise two bowl-shaped end parts and an essentially cylindrical intermediate part being sealingly interconnected.

6. A stable lattice work for use in forming concrete floors, comprising:

an upper reinforcement mesh having openings;

a lower reinforcement mesh having openings and disposed substantially parallel to the upper reinforcement mesh;

a plurality of hollow bodies disposed between the upper mesh and the lower mesh, the bodies being dimensioned and shaped so as to extend into respective openings of both the upper and lower meshes and be retained by the meshes; and interconnecting means for interconnecting the upper mesh and the lower mesh.

* * * * *